US005593562A

United States Patent [19]

Vickers

[11] Patent Number: 5,593,562

[45] Date of Patent: Jan. 14, 1997

[54] METHOD FOR IMPROVING FLAT PANEL DISPLAY ANODE PLATE PHOSPHOR EFFICIENCY

[75] Inventor: Kenneth G. Vickers, Whitesboro, Tex.

[73] Assignee: Texas Instruments Incorporated, Dallas, Tex.

[21] Appl. No.: 603,964

[22] Filed: Feb. 20, 1996

[51] Int. Cl.[6] ..... C25D 13/00

[52] U.S. Cl. ..... 204/486; 204/490; 204/491; 204/192.32; 204/192.34; 204/192.35; 427/64; 427/157; 427/271; 216/67; 156/643.1; 156/656.1

[58] Field of Search ..... 204/486, 490, 204/491, 192.32, 192.34, 192.35; 427/64, 157, 271; 216/67; 156/643.1, 656.1

[56] References Cited

U.S. PATENT DOCUMENTS

| | | | |
|---|---|---|---|
| 3,755,704 | 8/1973 | Spindt et al. | 313/309 |
| 4,857,799 | 8/1989 | Spindt et al. | 313/495 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,531,880 | 7/1996 | Xie et al. | 204/491 |
| 5,536,383 | 7/1996 | Van Danh et al. | 4/490 |

*Primary Examiner*—Kathryn Gorgos
*Assistant Examiner*—Kishor Mayekar
*Attorney, Agent, or Firm*—Rose Alyssa Keagy; Richard L. Donaldson

[57] ABSTRACT

A method of fabricating an anode plate 18 for use in a field emission device comprising the steps of providing a transparent substrate 20 and depositing a layer of a transparent, electrically conductive material 24 on a surface of the substrate. Next, portions of the layer of conductive material 24 are removed to form regions of the conductive material. Luminescent material 26 is then applied to the conductive regions 24, and a layer of electrically conductive material 23 is applied to the luminescent material 26. Outer portions of the conductive material 23 and an outer portion 27 of at least some of the particles 25 of the luminescent material are thereafter removed.

23 Claims, 4 Drawing Sheets

METHOD FOR IMPROVING FLAT PANEL DISPLAY ANODE PLATE PHOSPHOR EFFICIENCY

TECHNICAL FIELD OF THE INVENTION

The present invention relates generally to flat panel displays and, more particularly, a method for improving the phosphor efficiency of the anode plate of the field emission display.

BACKGROUND OF THE INVENTION

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,857,799, "Matrix-Addressed Flat Panel Display," issued 15 Aug. 1989, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frederic Clerc. These patents are incorporated by reference into the present application.

The Clerc ('820) patent discloses a trichromatic field emission flat panel display having a first substrate, on which are arranged a matrix of conductors. The first substrate is also called the cathode plate or the emitter plate. In one direction of the matrix, conductive columns comprising the cathode electrode support the microtips. In the other direction, above the column conductors, are perforated conductive rows comprising the grid electrode. The row and column conductors are separated by an insulating iayer having apertures permitting the passage of the microtips, each intersection of a row and column corresponding to a pixel.

On a second substrate, facing the first, the display has regularly spaced, parallel conductive stripes comprising the anode electrode. The second substrate is also called the anode plate. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

Luminescence is a characteristic nonthermal emission of electromagnetic radiation by a material upon some form of excitation. Thus, luminescence is the conversion. of energy into light without heat. The luminescence type is usually defined by the excitation means. For example, cathodoluminance is where the source of energy is cathode rays. The luminescence process itself involves (1) the absorption of energy; (2) excitation; and (3) the emission of energy, usually in the form of radiation in the visible portion of the spectrum; however, the emission can also be in the infrared or ultraviolet portions of the spectrum. Visible light constitutes one part of the electro-magnetic spectrum (approximately 4,000 Å–8,000 Å).

When the luminance persists after the excitation is removed it is called phosphorescence. Quantitatively, phosphorescence may be defined as luminescence that is delayed by more than $10^{-8}$ seconds after excitation. An inorganic luminescent material, such as phosphor, usually consists of a crystalline host lattice to which is added a trace of impurities, called the activator and co-activator. The activator is usually present in concentration levels varying from a few parts per million to one or two percent of the host lattice. Co-activators are the additional impurities which act as charge compensators or donors in the lattice.

Referring initially to FIG. 1, there is shown, in cross-sectional view, a portion of an illustrative prior field emission device in which the present invention may be incorporated. This device comprises an anode plate 1 having a cathodoluminescent phosphor coating 3 facing an emitter plate 2, the phosphor coating 3 being observed from the side opposite to its excitation.

More specifically, the field emission device of FIG. 1 comprises an anode plate 1 and an electron emitter (or cathode) plate 2. A cathode portion of emitter plate 2 includes conductors 9 formed on an insulating substrate 10, an electrically resistive layer 8 which is formed on substrate 10 and overlaying the conductors 9, and a multiplicity of electrically conductive microtips 5 formed on the resistive layer 8. In this example, the conductors 9 comprise a mesh structure, and microtip emitters 5 are configured as a matrix within the mesh spacings. Microtips 5 take the shape of cones which are formed within apertures through conductive layer 6 and insulating layer 7.

A gate electrode comprises the layer of the electrically conductive material 6 which is deposited on the insulating layer 7. The thicknesses of gate electrode layer 6 and insulating layer 7 are chosen in such a way that the apex of each microtip 5 is substantially level with the electrically conductive gate electrode layer 6. Conductive layer 6 may be in the form of a continuous layer across the surface of substrate 10; alternatively, it may comprise conductive bands across the surface of substrate 10.

Anode plate 1 comprises a transparent, electrically conductive film 12 deposited on a transparent planar support 13, such as glass, which is positioned facing gate electrode 6 and parallel thereto, the conductive film 12 being deposited on the surface of the glass support 13 directly facing gate electrode 6. Conductive film 12 may be in the for. m of a continuous layer across the surface of the glass support 13; alternatively, it may be in the form of electrically isolated stripes comprising three series of parallel conductive bands across the surface of the glass support 13, as shown in FIG. 1 and as taught in U.S. Pat. No. 5,225,820, to Clerc. By way of example, a suitable material for use as conductive film 12 may be indium-tin-oxide (ITO), which is substantially optically transparent and electrically conductive. Anode plate 1 also comprises a cathodoluminescent phosphor coating 3, deposited over conductive film 12 so as to be directly facing and immediately adjacent gate electrode 6. In the Clerc patent, the conductive bands of each series are covered with a particulate phosphor coating which luminesces in one of the three primary colors, red, blue and green $\mathbf{3}_R$, $\mathbf{3}_B$, $\mathbf{3}_G$.

Selected groupings of microtip emitters 5 of the above-described structure are energized by applying a negative potential to cathode electrode 9 relative to the gate electrode 6, via voltage supply 15, thereby inducing an electric field which draws electrons from the apexes of microtips 5. The potential between cathode electrode 9 and gate electrode 6 is approximately 70–100 volts. The emitted electrons are accelerated toward the anode plate 1 which is positively biased by the application of a substantially larger positive voltage from voltage supply 11 coupled between the cathode electrode 9 and conductive film 12 functioning as the anode electrode. The potential between cathode electrode 9 and anode electrode 12 is approximately 300–1000 volts. Energy from the electrons attracted to the anode conductive film 12 is transferred to particles of the phosphor coating 3, resulting in luminescence. The electron charge is transferred from phosphor coating 3 to conductive film 12, completing the electrical circuit to voltage supply 11. Charge can also be transferred by secondary electron emission. The image created by the phosphor stripes is observed from the anode side which is opposite to the phosphor excitation, as indicated in FIG. 1.

The process of producing each frame of a display using a typical trichromatic field emission display includes (1) applying an accelerating potential to the red anode stripes while sequentially addressing the gate electrodes (row lines) with the corresponding red video data for that frame applied to the cathode electrodes (column lines); (2) switching the accelerating potential to the green anode stripes while sequentially addressing the rows lines for a second time with the corresponding green video data for that frame applied to the column lines; and (3) switching the accelerating potential to the blue anode stripes while sequentially addressing the row lines for a third time with the corresponding blue video data for that frame applied to the column lines. This process is repeated for each display frame.

It is to be noted and understood that true scaling information is not intended to be conveyed by the relative sizes and positioning of the elements of anode plate 1 and the elements of emitter plate 2 as depicted in FIG. 1. For example, in a typical FED shown in FIG. 1 there are approximately one hundred arrays 4, of microtips per display pixel, and there are three color stripes $\mathbf{3}_R$, $\mathbf{3}_B$, $\mathbf{3}_G$ per display pixel. Furthermore, phosphor coating 3 may not be a dense coating, but instead be comprised of an arrangement of phosphor particles which have adhered to conductors 12.

The phosphor coating 3 of the anode plate 1 could be applied to the conductors 12 using the well known method of electrophoretic deposition. In general the process involves suspending phosphor powders in a nonaqueous polar organic liquid containing small quantities of dissociating salts. The cations from the added salts absorb onto the phosphor particles creating a net positive charge. These positively charged particles deposit on the anode stripes 12, which is the cathode during electrophoresis, when a potential is applied. In summary, the electrophoretic deposition process includes the charging of the particles to be deposited, the transport of the particles to the substrate, and the collection and adherence of the particles on the substrate.

Little is known regarding the true mechanism of phosphor adherence to the anode stripe conductors. Some scientists believe that the ions in the phosphor bath not only act to charge the phosphor positively, but also to form an adhesive oxide matrix which binds the phosphor particles to the conductors. Others theorize that the phosphor particles adhere to the conductor surface by electrostatic attraction.

The typical phosphor synthesis process creates a non-active surface layer (often called a "dead voltage layer") on the phosphor particles. This inactive surface layer, also referred to as 'skin' herein, contributes significantly to phosphor inefficiency. It is well known that the penetration depth of an electron into a phosphor particle is related to the kinetic energy of the electron. The penetration depth (called the mean-free path) of the electrons in the typical FED application is approximately 100 Å. Since thickness of the phosphor coating can be greater than 100 Å, a significant number of the electrons will recombine nonradiatively in the surface layer and will not produce luminance from the phosphor. The occurrence of nonradiative recombinations contributes to phosphor inefficiency and therefore adversely impacts display brightness and quality. The inactive surface region of the phosphor has a greater adverse effect in FED applications than in Cathode Ray Tube (CRT) applications because CRT's typically operate at a much higher voltage (25–30 kilovolts) and therefore the mean-free path is much greater and the phosphor efficiency is higher in CRT applications.

Luminous efficiency is defined as the ratio of the total luminous flux in lumens emitted by a light source over all wavelengths to the total incident energy in watts (current× volts). The value for lumens is adjusted to take into account the efficiency of the human eye.

It is well known that most of the commonly used flat panel display phosphors have a lower luminance efficiency at the acceleration voltage levels of the typical field emission device (below 1 kV) compared to other systems such as the Cathode Ray Tube (CRT) (25–30 kV). It is advantageous to operate the field emission device at the lower voltages because the low voltage operation simplifies spacer technology, reduces driver and interconnect cost, reduces display mortality caused by high voltage arcing, and allows the use of the switched anode design. Therefore, one shortcoming of field emission displays of the current technology is the reduced phosphor efficiency caused by the relatively low accelerating voltage between the cathode and anode plates. An improved luminance efficiency would facilitate improved display luminance and reduced power consumption.

In view of the above, it is clear that there exists a need for improved phosphor efficiency for field emission devices. More specifically, what is needed is an improvement in the structure and method of manufacturing the anode plate of a field emission flat panel display device which facilitates improved phosphor efficiency and higher luminance.

SUMMARY OF THE INVENTION

In accordance with the principles of the present invention, there is disclosed herein a method of fabricating an anode plate for use in a field emission device. The method comprises the steps of providing a transparent substrate and depositing a layer of a transparent, electrically conductive material on a surface of the substrate. Next, portions of the layer of conductive material are removed to form regions of the conductive material. Luminescent material is then applied to the conductive regions, and a layer of electrically conductive material is applied to the luminescent material. Outer portions of the conductive material and an outer portion of at least some of the particles of the luminescent material are thereafter removed.

The methods disclosed herein for forming the conductive material and removing portions of the conductive material and the inactive surface region of the phosphor particles overcome limitations and disadvantages of the prior art display devices and methods. Phosphor particles are generally non-conductive and therefor receive and store the charge created by the bombardment of the phosphor by the electrons emitted from the microtips. The resulting build-up of negative charge by the phosphor soon acts to repel subsequent incoming emitted electrons. This charge build-up lowers the phosphor's luminescent efficiency and thereby causes the display to dim. The addition of the conductive material greatly increases the lateral conductive path between phosphor particles, thereby allowing the phosphor particles to dissipate their electrical charge easily. The advantageous result is that the phosphors can quickly receive newly emitted electrons. The electrons released by the phosphors into the conductive material do not re-enter surrounding phosphors because the electrons are more attracted to the conductive material in the spaces between the phosphors than to the generally non-conductive phosphors. In summary the improved dissipation of charge results in a greatly enhanced luminescent efficiency Another advantage is that the phosphor particles remain in contact with the ITO layer. The charge drains from the phosphors laterally into the conductive material, yet the conductive material does not block the light emitted by the phosphors from traveling through the ITO layer to the viewer's eye.

Removing the conductive material and the inactive surface region of the phosphors at the surface of the arrangement will allow more electrons emitted from the microtips of the cathode plate to penetrate to the active region of the phosphor particles; thereby transferring more energy to excite luminescence. Thus, removal of the conductive material and the particle surface will reduce the loss of incident electrons in the conductive material and the inactive surface region of the phosphor particle which causes a reduced luminescence efficiency.

The result of the manufacturing process described above is a higher efficiency FED display than any prior art display at a low operating voltage. Furthermore, by reducing the operating voltage required to realize the desired luminance level, less power is consumed. Since the advantageously described processes for depositing the conductive material and removing selected conductive material and phosphor surfaces are well understood, all of these advantages are realized without the time and expense of developing a new enabling technology.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
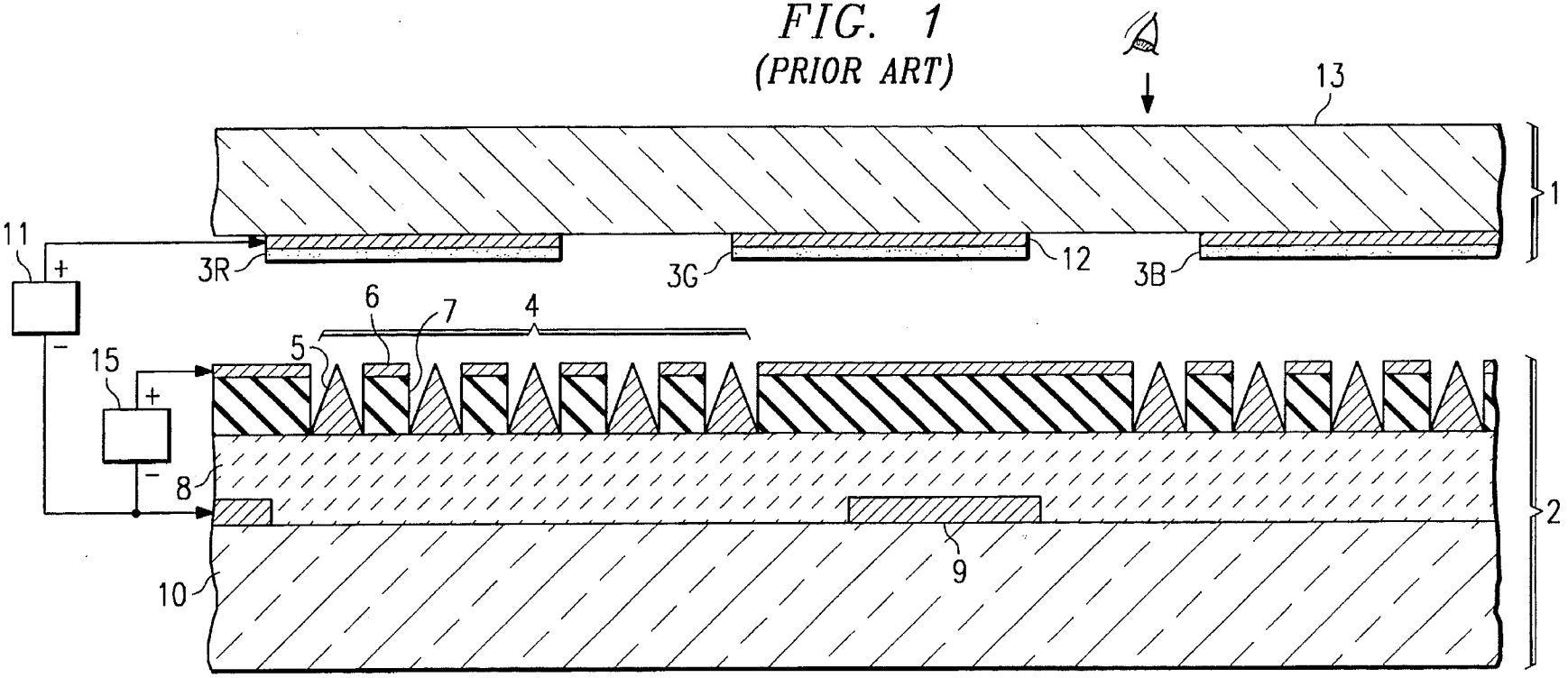
FIG. 1 (PRIOR ART)
FIG. 1 illustrates in cross section a portion of a field emission flat panel display device according to the prior art.
Figure 2:
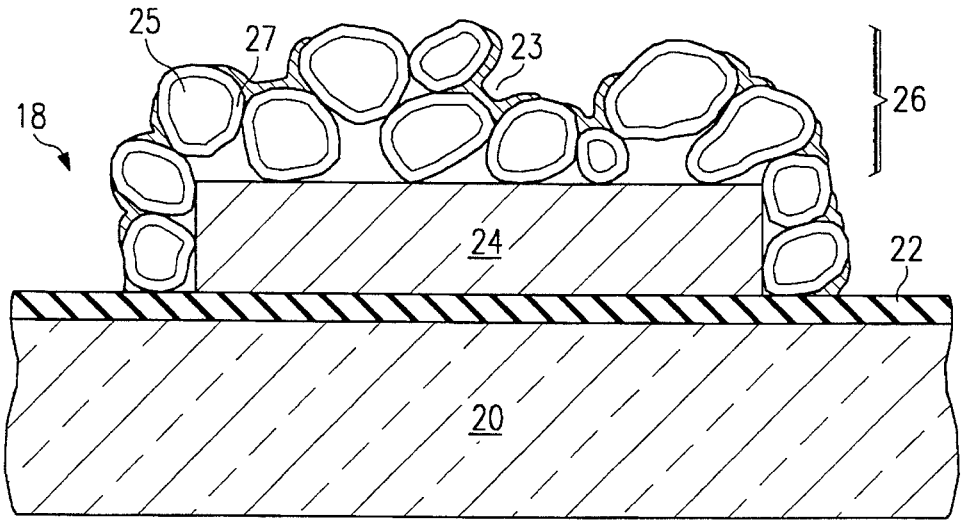
FIG. 2 is a cross-sectional view of an anode stripe region of the anode plate in accordance with the present invention.

Referring now to FIG. 2, there is shown a cross-sectional view of an anode plate in accordance with the present invention. Anode plate 18, shown inverted from the position of anode plate 1 of FIG. 1, comprises a transparent planar substrate 20, illustratively glass, having a layer 22 of an insulating material, illustratively silicon dioxide ($SiO_2$). A plurality of parallel conductive regions 24, referred to as anode stripes, are patterned on insulating layer 22. A suitable material for use as anode stripe conductors 24 may be indium-tin-oxide (ITO), which is optically transparent and electrically conductive. Conductive regions 24 collectively comprise the anode electrode of the field emission fiat panel display device of the present invention and extend normal to the plane of the drawing sheet.

Luminescent material 26 overlays anode stripe conductors 24 and comprises an arrangement of phosphor particles 25 which together luminesce in one of the three primary colors; red, green, and blue. A preferred process for applying phosphor layer 26 to stripe conductors 24 comprises electrophoretic deposition, described more fully below. An electrically conductive material 23 is formed in the spaces between the phosphor particles 25. The skin 27 of the phosphor particles 25, and most of the conductive material 23, facing the microtips 5 of the emitter plate 2 (shown in FIG. 1) is removed using one of a variety of techniques described more fully below. For purposes of this disclosure, as well as the claims which follow, the term "transparent" shall refer to a high degree of optical transmissivity in the visible range (the region of the electromagnetic spectrum approximately between 4,000–8,000 Å).

No true scaling information is intended to be conveyed by the relative sizes of the elements of FIG. 2. By way of illustration, stripe conductors 24 may be 70μ in width, and spaced from one another by 30μ. The thickness of conductors 24 may be approximately 1,500 Å, and the thickness of phosphor layer 26 may be approximately 5–10μ. The substrate 20 is approximately 1.1 mm thick and the insulating layer 22 is approximately 500 Å thick.

Figure 3:
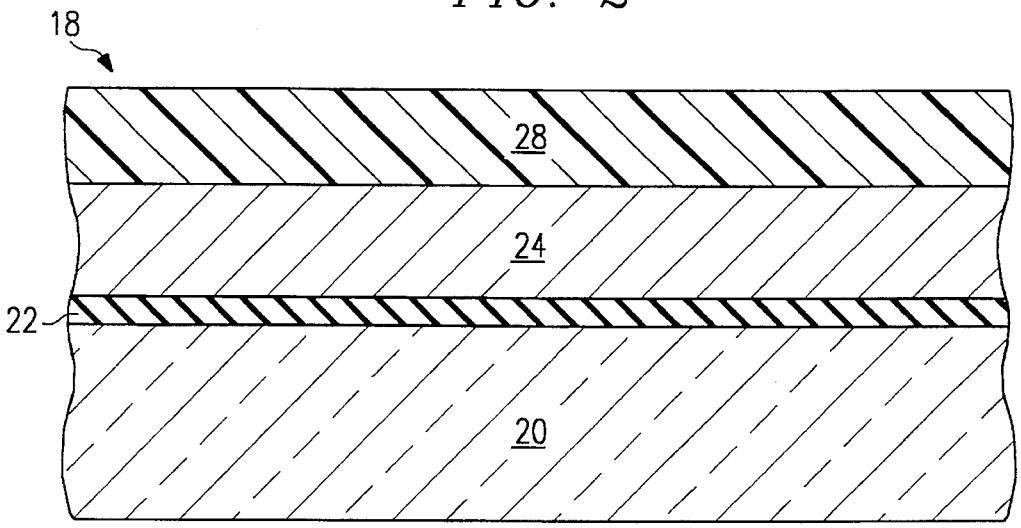
FIGS. 3 through 8 illustrate steps in a process for fabricating the anode plate of FIG. 2 in accordance with the present invention.
Figure 4:
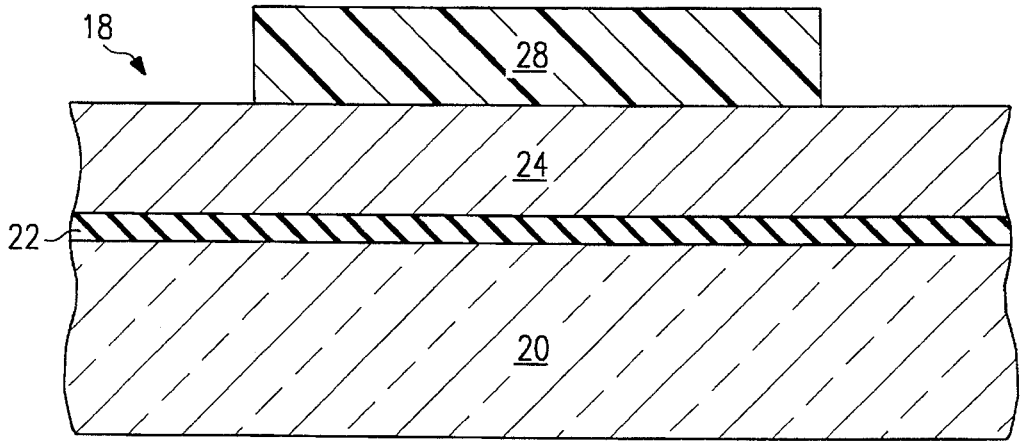
Figure 5:
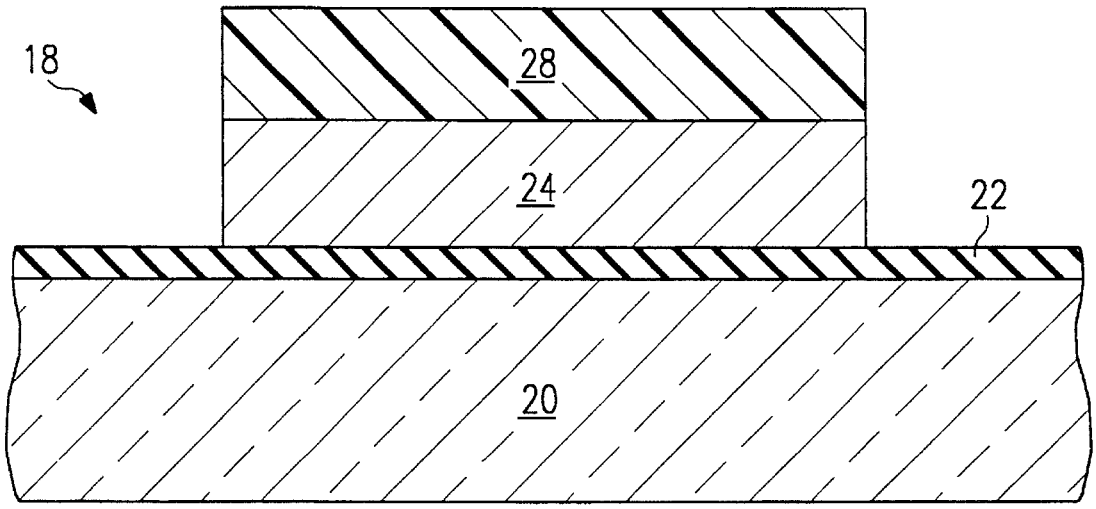

An illustrative method for manufacturing the anode plate 18 is as follows. Referring initially to FIG. 3, the glass substrate 20 is purchased with an $SiO_2$ insulating layer 22 which is 500 Å thick and a layer of ITO 24 which is 1,500 Å thick. A layer of photoresist 28, illustratively type AZ-1350J sold by Hoescht-Celanese of Somerville, N.J., is spun on over the ITO layer 24 to a thickness of approximately 10,000 Å. Next, a patterned mask (not shown) is disposed over the light-sensitive photoresist layer. The mask exposes desired regions of the photoresist to light. The mask used in this step defines anode stripes 24 which have a width of approximately 70μ. The exposed regions are removed during the developing step, which may consist of soaking the assembly in a caustic or basic chemical such as Hoescht-Celanese AZ developer. The developer removes the unwanted photoresist regions which were exposed to light, as shown in FIG. 4. The exposed regions of the ITO layer are then removed, typically by a reactive ion etch (RIE) process using carbon tetraflouride ($CF_4$) or a wet etch process using hydrochloric acid (HCl), leaving the structure shown in FIG. 5. Although not shown as part of this process, it may also be desired to remove $SiO_2$ layer 22 underlying the etched-away regions of the ITO layer 24.

Figure 6:
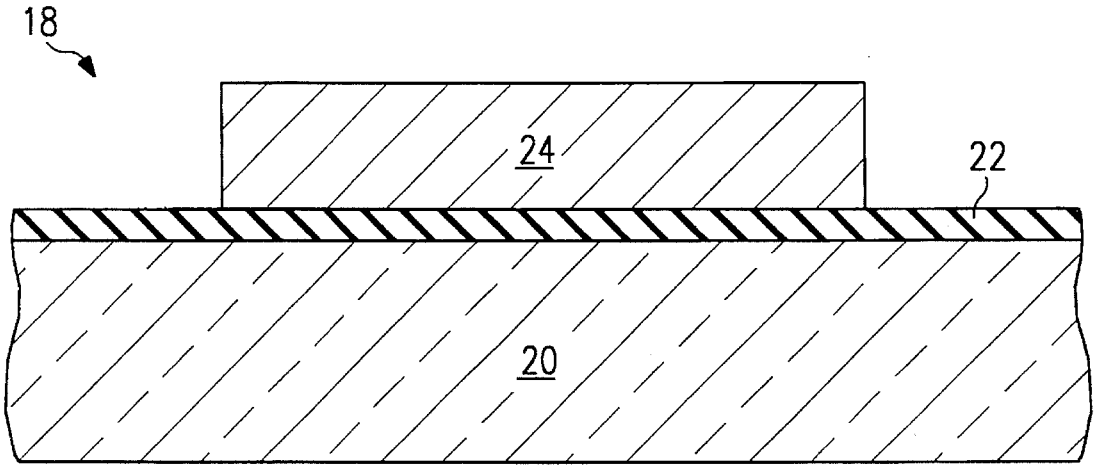

The remaining photoresist layer is removed by a wet strip process using commercial organic strippers or by plasma ashing, leaving the structure shown in FIG. 6. The portions of ITO which now remain on substrate 20 are anode regions or stripes 24.

The next step in the manufacturing process is to apply the phosphor particulate arrangement 26 using an electrophoretic deposition method, which is well known in the art.

More specifically, a cataphoretic coating process is used, whereby phosphor particles are suspended in an electrolytic medium, and after exposure to an electric field the charged phosphor particles move toward the anode stripes 24 which act as the cathode in this process. Illustratively, the phosphor layer 26 for the green anode stripes is formed first, then the process is repeated for the red and blue phosphor layers 26.

The first step in the electrophoretic deposition process is the manufacture or purchase of the phosphor powder. There are generally three stages to the phosphor powder preparation. However, for any particular type of phosphor, various methods of preparation are known. The first stage involves purification of the raw materials and synthesis of the constituent phosphor compound. The second stage involves the growth of phosphor particles by firing. The third stage involves the treatment of the fired phosphor powder to make it suitably luminescent for display use. Skins 27 will naturally form on the phosphor particles 25 during this phosphor synthesis.

Once the phosphor particles are obtained, the particles are suspended in a polar organic solution called the phosphor bath. In the illustrative deposition of the green phosphor layer 26, the phosphor particles are Terbium:GadoliniumOxysulfide ($Tb:Gd_2O_2S$). The phosphor bath contains, for example, about 10 grams of the phosphor powder, about 200 milligrams of a suitable electrolyte such as calcium, barium, magnesium, or other nitrates, and about 900 milliliters of alcohol. The cationic additives are absorbed by the phosphor particles in the phosphor bath and thereby create a net positive charge on the particles.

Although the electrophoresis process has been used for many years in the manufacture of screens for cathode ray tubes, the mechanism is not totally understood. Therefore, for each type of phosphor particle to be used in the manufacture of the FED, the charging agents, nonaqueous media, and the processing conditions to produce the desired screen characteristics are typically chosen empirically.

A mechanical shorting clamp, which is well known in the processing art, is attached to the anode plate 18 such that all green anode stripes 24 are shorted together. A negative voltage is now applied to all of the green anode stripes 24. The voltage applied to the green anode stripes 24 is illustratively 2–10 V. While the charge is applied to the green anode stripes 24 of anode plate 18, the anode plate is immersed in the phosphor bath and a positive electrode grid is placed parallel to the substrate. The time of immersion is illustratively one minute; however, the time of immersion may be increased or decreased depending on the thickness of phosphor layer 26 desired. The resulting applied electric field then causes the positively charged green phosphor particles to migrate to the conductors 24 comprising the green anode stripes. The anode plate is now rinsed in alcohol for approximately one minute in order to remove phosphor particles which haven't sufficiently adhered to the anode stripes.

Figure 7:
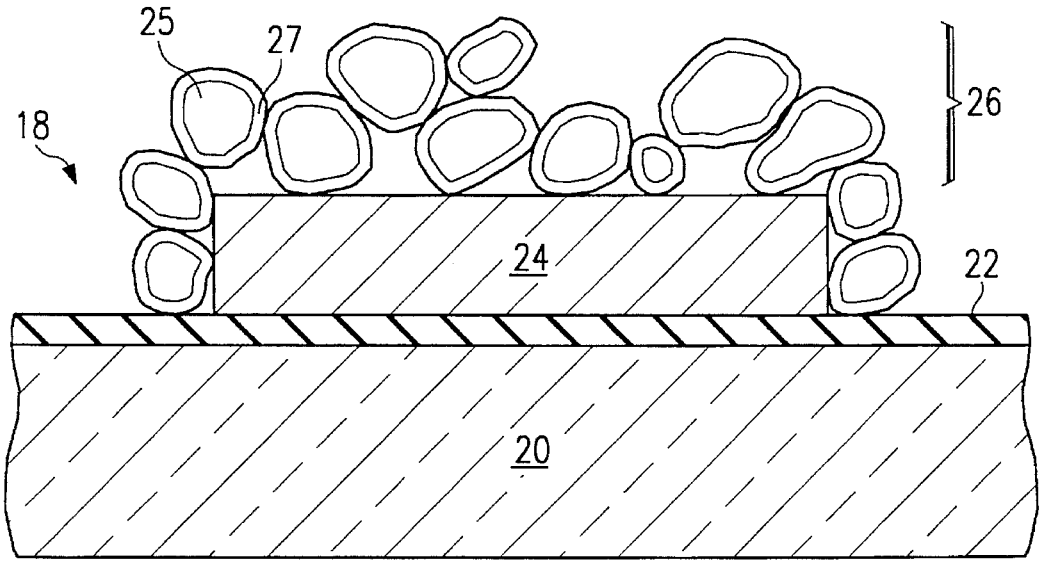

The cataphoretic deposition process just described is then repeated two more times in order to form the red phosphor arrangement 26, illustratively using $Y_2O_2S:Eu$, and the blue phosphor arrangement 26, illustratively using ZnS:Ag. The cataphoretic deposition process has the advantages of creating a phosphor layer 26 of relatively uniform thickness and uniform density in a controllable manner. After the green, red, and blue phosphor arrangements are formed, the anode plate is baked at 350°–400° C., causing the phosphor particles to adhere to the conductors 24 by formation of a oxide matrix. The structure of the anode plate 18 at this point in the manufacturing process is shown in FIG. 7.

Figure 8:
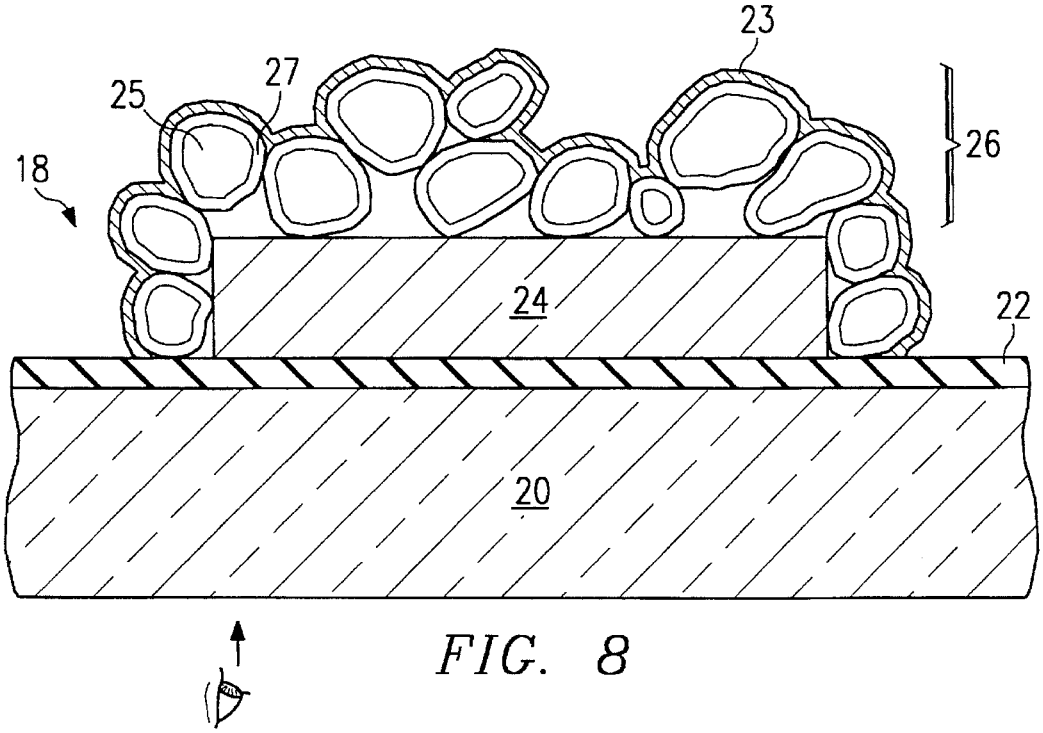

A layer of electrically conductive material 23 is now deposited over the phosphor layer 26, as shown in FIG. 8. The deposition of the conductive material 23 may be accomplished in one of many ways. One method ia a standard sputtering process using argon atoms and a vacuum of approximately $10^{-2}$ to $10^{-3}$ torr. A bias is applied which ionizes the argon atoms and accelerates them toward a sputter target. As the argon atoms collide with the target of conductive material, particles of conductive material are removed from the target and travel toward the anode plate 18 and eventually builds a film of conductive material 23 over the phosphor layer 18. Illustratively, the conductive material 23 is aluminum sputtered to a depth of approximately 500 Å. The use of the sputtering technique to deposit the conductive material 23 results in good penetration of aluminum between the phosphor particles 25 plus good sidewall coverage of the phosphor particles 25.

However, there are many other techniques which may be used to deposit the conductive material 23. Maximum penetration between phosphor particles may be obtained by depositing the conductive material 23 with the well known process of evaporation. Using 90° evaporation in a vacuum of approximately $10^{-6}$ torr, electrons may be ejected from the evaporation source gun toward a pot of desired conductive material. The collision of the electrons with the conductive material heats the material to its evaporation point, causing metal atoms to leave the pot and travel in a collision free path until they strike the anode plate held with the phosphor arrangement 26 normal to the evaporative metal path. Again the conductive material is illustratively aluminum. However other conductive materials such as copper or gold may be used.

The 90° evaporation technique will result in a conductive film 23 which penetrates the crevices between the phosphor particles 25 better than the film 23 deposited by the sputter technique. But the film 23 deposited by sputtering will have better sidewall coverage than the film 23 created with evaporation at an angle 90° to the surface of anode plate 18. Furthermore, the aluminum may penetrate the crevices between the phosphor particles 25 better if the evaporation is performed with a slight wobble and rotation around the anode plate's axis normal to its surface.

Another method for obtaining good conductive material coverage of the sidewalls of the phosphor layer 26 is by the use of the standard evaporation technique with a rotating shallow angle. The shallow evaporation angle will direct the aluminum particles toward the anode plate at an angle which allows the aluminum particles to more easily deposit on the sidewalls of the phosphor arrangement 26.

While it would increase manufacturing costs, a combination of more than one method could be advantageous. Still other standard techniques, such as Chemical Vapor Deposition (CVD) or Spin On Glass (SOG), may be used to deposit conductive material 23. It may even be desirable to coat the phosphor particles 25 with the conductive material before depositing the particles 25 by electrophoresis. However, the disadvantage of coating the phosphor particles 25 before depositing the particles onto the conductive ITO stripes 24 is that it results in a layer of conductive material 23 which is in-between the phosphor particles 25 and the ITO 24. The conductive material located between the phosphor particles and ITC) 24 forms a light barrier which blocks the travel of light from the phosphor particles 25 to the viewer's eye.

In order to prevent electrical shorting between conductive ITO stripes 24, the conductive material 23 should be absent from the areas between the ITO stripes 24. This can be accomplished in any one of a number of well known ways. For example, photoresist may be deposited between the ITO stripes 24 before the conductive material 23 is deposited, Then after the conductive material 23 is deposited, the photoresist can be removed, thereby also removing the conductive material 23 formed on top of the photoresist. Alternatively, the conductive material 23 may be removed with standard etching techniques after the conductive material 23 has been deposited.

The next step in the manufacturing process of the anode plate 18 is to abrade, or remove, an outer portion of the inactive surface layer, or skin, 27 of the phosphor particles 25, as well as an outer portion of the conductive material 23, at the surface of arrangement 26 which faces the cathode plate. The removal of the conductive material and the inactive surface layer 27 on the exposed outer particles 25 of arrangement 26 will increase phosphor efficiency by allowing the electrons emitted by the microtips of the cathode plate to more easily penetrate to the active centers of the phosphor particles.

The inactive surface layer 27 on the exposed outer surfaces of arranged phosphor particles 26 is removed by the well known technique of ion milling, as summarized below. Other methods, such as sputtering or ion etching, could also be used in replacement of (or in addition to) ion milling.

The ion milling process involves placing the anode plate in a vacuum and using an ion gun to direct an inert gas, illustratively argon, in a raster motion to the surface layer of the phosphor arrangement 26. The ion milling is preferably done at a grazing angle of approximately 30° while rotating the anode plate 18 around a normal axis. This technique will cause bombardment of the surface of the phosphor particles 25 at all angles without penetrating between the particles. Alternatively, the sputtering process involves placing the anode plate in a vacuum and directing a spray of inert gas, such as argon, to the anode plate.

In both processes, the physical impact of the argon ions hitting the surface of arrangement 26 transfers energy to the surface of the arrangement 26 removing the outer surface of conductive material 23 and the outer phosphor surface 27. The rate of material removal from the particles is illustratively 50 Å per minute. Therefore, to insure removal of the outer portions of conductive material 23 and coating 27, the ion milling process continues for approximately 5–10 minutes, removing sufficient material from the surface of the phosphor arrangement 26 to expose the active phosphor compound. It is within the scope of this invention to change the duration of the milling process in order to remove more of less of the surface material from the phosphor arrangement 26. The resulting advantageous structure is shown in FIG. 2.

Several other variations in the above processes, such as would be understood by one skilled in the art to which it pertains, are considered to be within the scope of the present invention. As a first such variation, it will be understood that a hard mask, such as aluminum or gold, may replace photoresist layer 28 of the above process. Also, while the disclosure describes a manufacturing process using positive photoresist, a manufacturing process employing negative photoresist is also comprehended. In addition, the ITO 12 does not have to be etched to create anode stripes in FED systems which operate in frame sequential mode.

Other phosphors which may be used to create the red, green, and blue phosphor arrangements 26 are comprehended by this invention. Furthermore, the phosphor particles could be deposited using a dusting or a slurry technique. Moreover arrangement 26 could be a phosphor film layer instead of an arrangement of phosphor particles. In addition, other gases such as neon or krypton may be used in the evaporation, ion milling, or sputtering processes.

Finally, while the disclosure describes the use of the sputtering and ion milling techniques to remove the phosphor coating 27, alternative physical or chemical processes may be used. For example, a Reactive Ion Etch (RIE) using halogens such as chlorine- or fluorine-based chemistries would also remove portions of conductive material 23 and coating 27 through a chemical process. This alternative may be desirable because the process could be accomplished at lower voltages and therefore would be less likely to cause any damage the phosphor particles.

The methods disclosed herein for forming the conductive material and removing portions of the conductive material and the inactive surface region of the phosphor particles overcome limitations and disadvantages of the prior art display devices and methods. Phosphor particles are generally non-conductive and therefor receive and store the charge created by the bombardment of the phosphor by the electrons emitted from the microtips. The resulting build-up of negative charge by the phosphor soon acts to repel subsequent incoming emitted electrons. This charge build-up lowers the phosphor's luminescent efficiency and thereby causes the display to dim. The addition of the conductive material 23 greatly increases the lateral conductive path between phosphor particles, thereby allowing the phosphor particles to dissipate their electrical charge easily. The advantageous result is that the phosphors can quickly receive newly emitted electrons. The electrons released by the phosphors into the conductive material do not re-enter surrounding phosphors because the electrons are more attracted to the conductive material in the spaces between the phosphors than to the generally non-conductive phosphors. In summary the improved dissipation of charge results in a greatly enhanced luminescent efficiency Another advantage is that the phosphor particles remain in contact with the ITO layer. The charge drains from the phosphors laterally into the conductive material, yet the conductive material does not block the light emitted by the phosphors from traveling through the ITO layer to the viewer's eye.

Removing the conductive material and the inactive surface region of the phosphors at the surface of the arrangement will allow more electrons emitted from the microtips of the cathode plate to penetrate to the active region of the phosphor particles; thereby transferring more energy to excite luminescence. Thus, removal of the conductive material and the particle surface will reduce the loss of incident electrons in the conductive material and the inactive surface region of the phosphor particle which causes a reduced luminescence efficiency.

The result of the manufacturing process described above is a higher efficiency FED display than any prior art display at a low operating voltage. Furthermore, by reducing the operating voltage required to realize the desired luminance level, less power is consumed. Since the advantageously described processes for depositing the conductive material and removing selected conductive material and phosphor surfaces are well understood, all of these advantages are realized without the time and expense of developing a new enabling technology.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating an anode plate for use in a field emission display device, said method comprising the steps of:

providing a transparent substrate having electrically conductive regions on a surface of said substrate;

applying particles of luminescent material on said conductive regions;

applying a layer of electrically conductive material on said luminescent particles; and removing portions of said conductive layer and portions of at least some of said luminescent particles by abrading.

2. The method in accordance with claim 1 wherein said step of applying particles of luminescent material on said conductive regions comprises depositing said luminescent material on said conductive regions by electrophoresis.

3. The method in accordance with claim 2 wherein said particles of luminescent material includes phosphors.

4. The method in accordance with claim 1 wherein said step of removing portions of said conductive layer and portions of at least some of said luminescent particles by abrading comprises sputtering.

5. The method in accordance with claim 1 wherein said step of removing portions of said conductive layer and portions of at least some of said luminescent particles by abrading comprises ion milling using an ionized inert gas.

6. The method in accordance with claim 5 wherein said inert gas includes argon.

7. The method in accordance with claim 1 wherein said step of removing portions of said conductive layer and portions of at least some of said luminescent particles by abrading comprises etching.

8. The method in accordance with claim 7 wherein said etching step includes plasma etching.

9. The method in accordance with claim 8 wherein said plasma etching comprises sputtering.

10. The method in accordance with claim 7 wherein said etching step includes ion milling.

11. The method in accordance with claim 7 wherein said etching step includes reactive ion etching (RIE).

12. The method in accordance with claim 1 wherein said step of applying a layer of electrically conductive material on said luminescent particles includes evaporating aluminum.

13. The method in accordance with claim 1 wherein said step of applying a layer of electrically conductive material on said luminescent particles includes sputtering aluminum.

14. The method in accordance with claim 1 wherein said step of applying a layer of electrically conductive material on said luminescent particles includes chemical vapor deposition of tungsten.

15. A method of fabricating an anode plate for use in a field emission display device, said method comprising the steps of:

providing a transparent substrate;

depositing a first layer of electrically conductive material on a surface of said substrate;

removing portions of said first layer of conductive material to form conductive regions of said conductive material;

applying particles of luminescent material on said conductive regions;

applying a second layer of electrically conductive material on said luminescent particles; and removing portions of said second conductive layer and portions of at least some of said luminescent particles by abrading.

16. The method in accordance with claim 15 wherein said step of removing portions of said first layer of conductive material comprises the sub-steps of:

coating said surface with a layer of photoresist;

masking said photoresist layer to expose areas corresponding to said conductive regions;

developing said exposed areas of said photoresist layer;

removing the developed areas of said photoresist layer to expose areas of said first layer of conductive material;

removing said exposed areas of said first layer of conductive material; and removing the remaining photoresist layer.

17. The method in accordance with claim 16 wherein said first layer of electrically conductive material is transparent.

18. The method in accordance with claim 17 wherein said first layer of electrically conductive material comprises indium tin oxide (ITO).

19. A method of fabricating an anode plate for use in a field emission display device, said method comprising the steps of:

providing a transparent substrate;

depositing a first layer of a transparent, electrically conductive material on a surface of said substrate;

applying particles of luminescent material on said first conductive layer;

applying a second layer of electrically conductive material on said luminescent particles; and removing portions of said second conductive layer and portions of at least some of said luminescent particles by abrading.

20. A method of fabricating an anode plate for use in a field emission display device, said method comprising the steps of:

providing a transparent substrate;

depositing a first layer of a transparent, electrically conductive material on a surface of said substrate;

removing portions of said first layer of conductive material to form regions of said conductive material;

applying a film layer of luminescent material on said conductive regions;

applying a second layer of electrically conductive material on said luminescent film; and removing portions of said second conductive layer and portions of at least some of said luminescent film by abrading.

21. A method of fabricating an anode plate for use in a field emission display device, said method comprising the steps of:

providing a transparent substrate;

depositing a first layer of electrically conductive material on a surface of said substrate;

applying particles of luminescent material on said conductive regions;

applying a second layer of electrically conductive material on said luminescent particles; and removing portions of said second conductive layer and portions of at least some of said luminescent particles by abrading.

22. The method in accordance with claim 21 wherein said first layer of electrically conductive material is transparent.

23. The method in accordance with claim 22 wherein said first layer of electrically conductive material comprises indium tin oxide (ITO).

* * * * *